US007341242B2

(12) United States Patent
Bertato

(10) Patent No.: US 7,341,242 B2
(45) Date of Patent: Mar. 11, 2008

(54) FENCE SYSTEM

(76) Inventor: Maurizio C. Bertato, 4 Blue Ridge Trail, Newmarket, Ontario (CA) L3Y 4W1

( * ) Notice: Subject to any disclaimer, the term of this patent is extended or adjusted under 35 U.S.C. 154(b) by 0 days.

(21) Appl. No.: 10/938,592

(22) Filed: Sep. 13, 2004

(65) Prior Publication Data

US 2006/0076546 A1 Apr. 13, 2006

(51) Int. Cl.
*E04H 17/14* (2006.01)

(52) U.S. Cl. ..... 256/65.11; 256/65.12

(58) Field of Classification Search ..... 256/21, 256/22, 66, 70, 65.01, 65.03, 65.11–12
See application file for complete search history.

(56) References Cited

U.S. PATENT DOCUMENTS 448,029 A 3/1891 Hanika ..... 256/65.06
3,498,589 A * 3/1970 Murdock ..... 256/70
4,014,520 A * 3/1977 Walters ..... 256/22
4,667,935 A * 5/1987 Moore ..... 256/22
6,029,954 A * 2/2000 Murdaca ..... 256/59
6,702,259 B2 * 3/2004 Pratt ..... 256/65.03
6,874,766 B2 * 4/2005 Curatolo ..... 256/59
2002/0175321 A1 * 11/2002 Larsen et al. ..... 256/65.1
2003/0151039 A1 * 8/2003 Zen et al. ..... 256/26

* cited by examiner

*Primary Examiner*—Daniel P. Stodola
*Assistant Examiner*—Joshua T. Kennedy

(57) ABSTRACT

A fence system which can be erected on site and comprising a set of transverse rails of metallic material, formed as hollow sections, a plurality of vertical balusters, which can be interengaged with the transverse rails; and a plurality interconnecting devices which are attachable to the vertical balusters, and which interengage with the interior of the transverse rails, so that the vertical balusters can be connected with the transverse rails at spaced intervals.

17 Claims, 7 Drawing Sheets

FENCE SYSTEM

FIELD OF THE INVENTION

The invention relates to a fence system for erecting a fence around a property or around a balcony, deck or the like, in an economical manner from a kit of parts.

BACKGROUND OF THE INVENTION

It is usual to erect a fence around a deck, or on a balcony. Fences are often erected around properties. In most cases it is desirable that the fence will be aesthetically pleasing and decorative, as well as effective in its purpose. interior rails are used on stairs and other locations.

Fences are usually made of a system of vertical and transverse, members. Usually the members are made of wood. Wooden fences while having a pleasing aesthetic appearance have a relatively short life and are easily damaged. They are difficult to repair when they become rotted and must be pulled down and replaced. in addition, wooden fences require frequent maintenance.

For this and many other reasons, it is common to erect fences of iron work, In the past these may have been cast iron, but wrought iron fences are also common. In these cases the iron fences must usually be designed and constructed in a factory to the exact dimensions required for the particular application. Once erected, the fences have a long useful life. However, iron weathers easily and must receive frequent maintenance including removal of rust, repainting with rust-proof paint and then painting with a decorative finish.

Usually iron fences of this type are erected by contractors. A contractor is required to measure the location and the purchaser will then select a design and a contractor then constructs the various fence components in a factory and brings them to the site to install.

This is a relatively expensive process and tends to greatly increase the cost of such iron fences.

Clearly, a form of kit of parts for constructing a fence or rail system at home- by a home handyman or even by the individual property owner would be of much lower cost and thus produce a wider market.

In addition, by selecting more suitable materials for building outdoor fences, it will be possible to have a fence with a virtually indefinite life without requiring any maintenance, and without deteriorating due to weathering.

Various fence kit systems have been proposed. For example in U.S. Pat. No. 1,376,150 dated 1921 there is proposed a fence or rail kit system having an upper rail and a lower rail each made apparently of two telescoping components. Vertical posts extend between the lower and upper rails and are held in place by inter-engagement with one of the telescoping parts of the upper and lower rails.

In U.S. Pat. No. 4,667,935 dated 1987 there is disclosed another fence kit. In this case the horizontal rails are simply provided with holes and what appear to be screw openings. The vertical posts are slipped through the holes and are fastened in place by what appear to be set screws. The kit also provides various junction devices for holding the ends of the posts onto a building structure, and corner connectors for connecting corners.

U.S. Pat. No. 5,454,548 discloses another system of a fence kit. This system is in many respects quite similar to the system in the U.S. Pat. No. 1,376,150 in 1921. This system discloses a rail of hollow rectangular construction having a sliding telescoping component extending through it. The vertical posts are provided with notches. A portion of the telescoping sliding component slides into engages with the notches and holds the posts in the rails.

All of these systems would require some relatively difficult operations by an installer and would not be entirely suitable for use by a home handyman or individual property owner.

In addition, the use of multiple fastening components of this type introduces the possibility of errors in positioning of the interlocking parts such that they will not readily fit together and in addition there appears to be no secure shake free engagement. In each case the rail and post system would be liable to vibration and movement. Another difficulty of these systems with interlocking parts is that the interlocking components must interfit at certain precise intervals along their length. These intervals will be determined by the way in which the kit is manufactured in the factory. As a result, the purchaser has a limited choice of design available to him.

Clearly, it would be an advantage to the home owner or home handyman, if a fence kit could be obtained which could be cut to size to suit the particular location, whether it be a front yard, a deck, a balcony, or even for example a stair rail, and then erected by him in position. Preferably, such a fence system would be free of any exterior projecting fastenings, and would provide a rigid solid fence structure which would not loosen or fall apart over time. In addition, in this type of system, the vertical posts should preferably be connectable to the transverse members by some form of connections which do not require machining of parts in a factory.

BRIEF SUMMARY OF THE INVENTION

With a view to providing a fence system in kit form, which can be erected by a home owner or a home handyman, the invention comprises a set of transverse rails of metallic material, having a hollow interior, and a plurality of vertical posts, preferably cylindrical, and tubular, which can be interengaged with the transverse rails; and a plurality interconnecting devices which are attachable to the vertical posts, and which interengage with the interior of the transverse rails, so that the posts can be connected with the transverse rails at any desired locations and spacings, and with the interconnecting devices concealed and enclosed within the transverse rails.

Preferably, the transverse rails and posts will be formed of metallic material, especially aluminium, which may have an exterior finish permanently applied in the factory, and which will be highly resistant to weathering. Steel with a suitable finish can also be used in some cases.

An additional advantage of this is that the aluminium material is relatively easy to operate with, for the home handyman. All that is required is a simple drill, and a metal saw, and the parts may be readily prepared and assembled without any special tools or welding equipment. Being relatively soft aluminium can also be fastened with a suitable nail or screw.

Preferably, fastenings are provided for fastening the attachments to the posts, and when the attachments are secured in the transverse rails, the fastenings are concealed so that they do not protrude to the exterior of the fence where they may cause injury or provide an unsightly appearance, or become loose.

In one preferred example the transverse rails comprise generally three sided channels, inverted, and open downwardly. The cavity in the channel will be sized and shaped to interfit with the interconnectors for that system.

Various different alternative connector devices can be used for connecting the vertical posts and transverse rails. In addition, the invention also provides for various decorative attachments such as finials and various shapes and designs which can be interposed between the posts so as to simulate designs of cast iron fencing.

In order to provide for the erection of stairs and stair rails, angular connections are also provided as an optional feature. These enable the transverse rails to be set at angles to correspond to the angle of the stairs for example. In addition, connectors can be provided to provide both right angle joints and non-right angular joints in between the length of transverse rails so as to provide a fence conforming to the shape of a particular area for example.

The interconnectors may be formed of plastic material, or may be metallic.

The various features of novelty which characterize the invention are pointed out with more particularity in the claims annexed to and forming a part of this disclosure. For a better understanding of the invention, its operating advantages and specific objects attained by its use, reference should be made to the accompanying drawings and descriptive matter in which there are illustrated and described preferred embodiments of the invention.

IN THE DRAWINGS

DESCRIPTION OF A SPECIFIC EMBODIMENT

Figure 1:
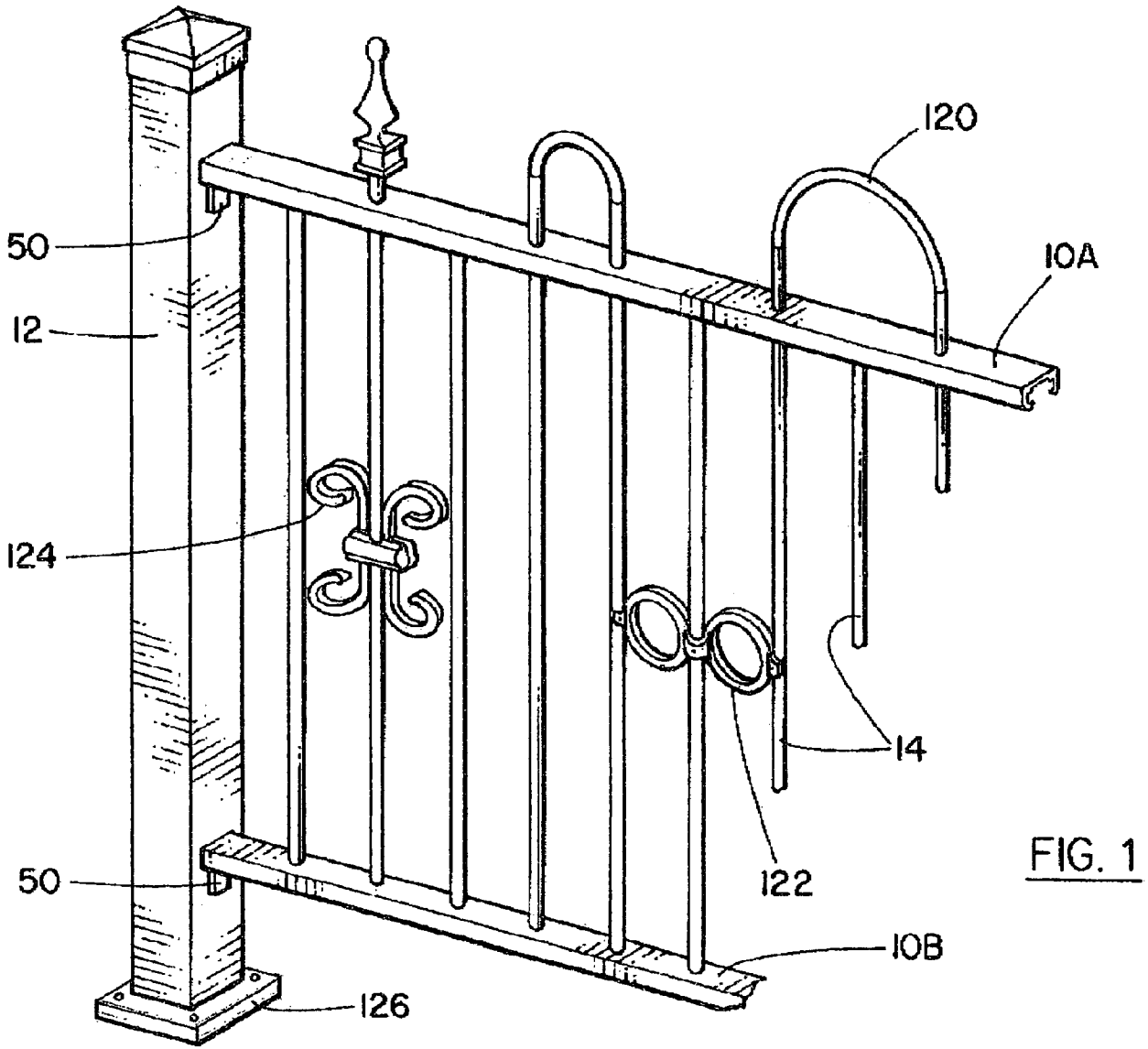
FIG. 1 is a perspective illustration of a typical fence illustrating the invention in use.

Referring to FIG. 1, it will be seen that this illustrates the invention in the form of a fence around a deck, or a yard.

It will of course be appreciated the invention is equally applicable to the erecting of a fence or rail system alongside stairs, either outside or inside, and also around balconies, and around any other areas which may require a fence or railing. It may also be used as a separation for example around an outdoor seating area at a restaurant. For this purpose the invention will be seen to consist generally of at least two generally transverse rails and (10A) and (10B).

There may be three such transverse rails in the case of some fences.

Typically the transverse rails will surround an area, and will be connected by means to be described to vertical support posts (12). Such posts (12) may be located at spaced intervals along a length of fence, and will also usually be located at corners, in known manner. These connections may be at right angles or may be at any other angle, by means to be described below.

A plurality of vertical balusters (14) are provided in parallel spaced apart relation extending between the transverse rails (10A) and (10B). The intent is to provide a fence or railing system having an aesthetic pleasing appearance, similar to the appearance of other fence systems.

Figure 3:
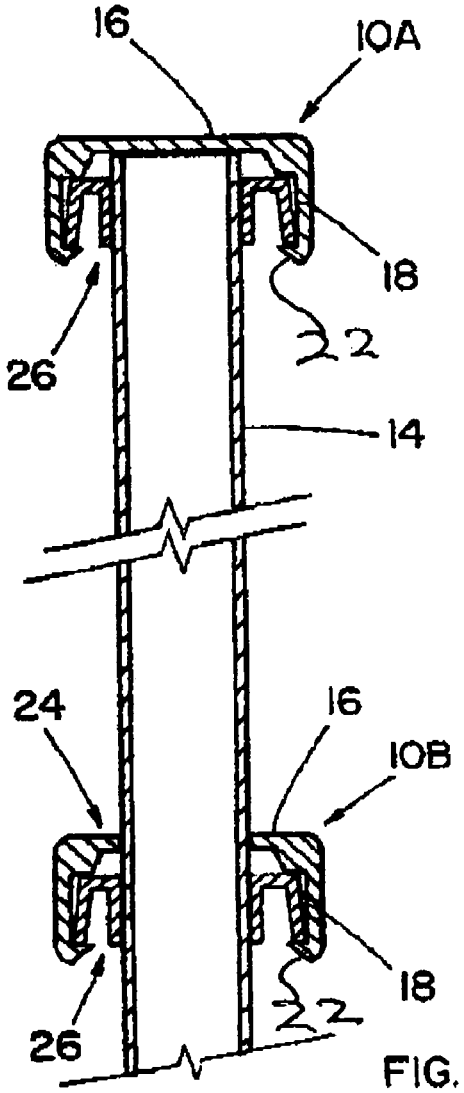
FIG. 3 is a section along the line 3—3 of FIG. 1.
Figure 2:
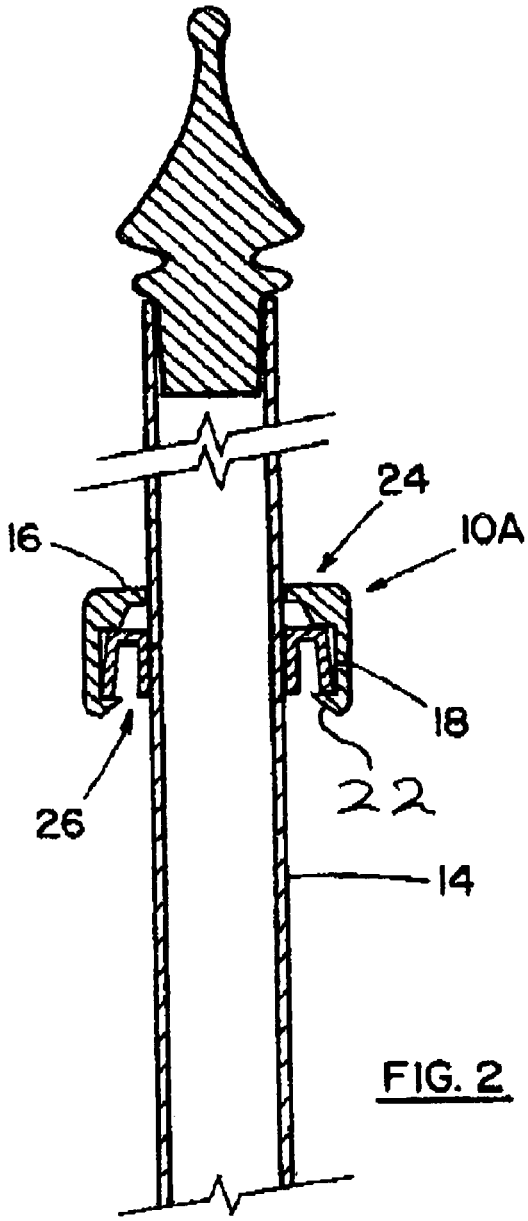
FIG. 2 is a section along the line 2—2 of FIG. 1.

Referring now to FIGS. 2 and 3 it will be seen that, in this embodiment, the transverse rails (10A), (10B) are formed as inverted hollow three-sided channels, in this embodiment. Each hollow channel defines an upper transverse web (16), and two downwardly dependent side walls (18—18).

The interior of the transverse web (16) is formed in this embodiment with two shoulders (20—20) having inwardly tapering surfaces. The lower edges of the side walls (18—18) are formed with inwardly directed hook portions (22—22). Such channels define hollow interior cavities and are formed by extruding techniques, the preferred material being aluminium or a suitable alloy. Such material is essentially free of deterioration due to weathering, and may be given a substantially permanent finish in a variety of ways, allowing for the production of a fence having a pleasing appearance and extended useful life. Steel can also be used in some cases, being formed in any suitable manner for example by roll forming, and being coated with a suitable protective coating (not shown) such as is well known to those skilled in the art.

Each of the vertical balusters (14—14) in this embodiment are formed of a tubular extruded material, again aluminium being the preferred material and given a suitable exterior finish. The round tubular shape of the vertical baluster is easy to produce, and can be easily assembled by a home handyman or a home owner in the manner described below. In order to assemble the vertical balusters (14—14) in relation to the transverse rails (10A) (10B), the transverse rails are formed with baluster openings to receive the balusters, at spaced intervals, as at baluster openings (24). These baluster openings may in fact be inserted by the home owner or handyman himself at desired intervals. Alternatively pre-drilled transverse rails (10A) (10B) may be made available in a kit form so that the actual hand work to be carried out by the home handyman is minimized.

The openings (24) may be formed through the web (16) of the hollow channels of the both transverse rails (10A) and (10B). Alternatively the upper rail (10A) may be left free of openings (24). In this case the balusters end (14)within the rail (10A) as shown in FIG. 3.

Figure 4:
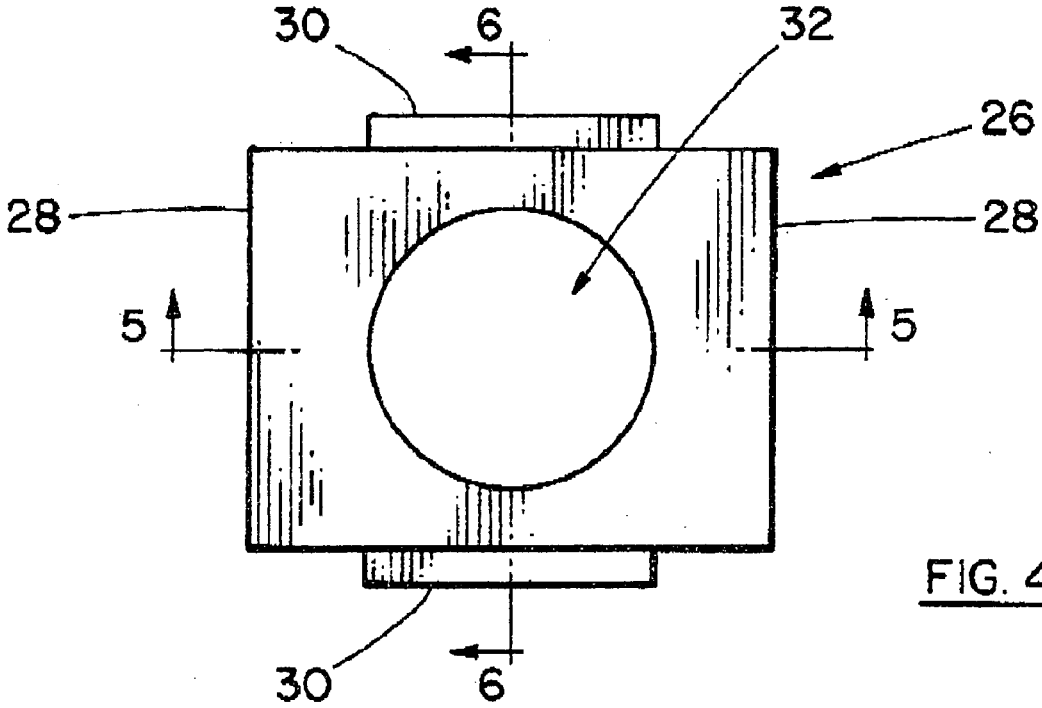
FIG. 4 is a plan view of one form of connector for the connecting the vertical posts to the transverse rails.
Figure 5:
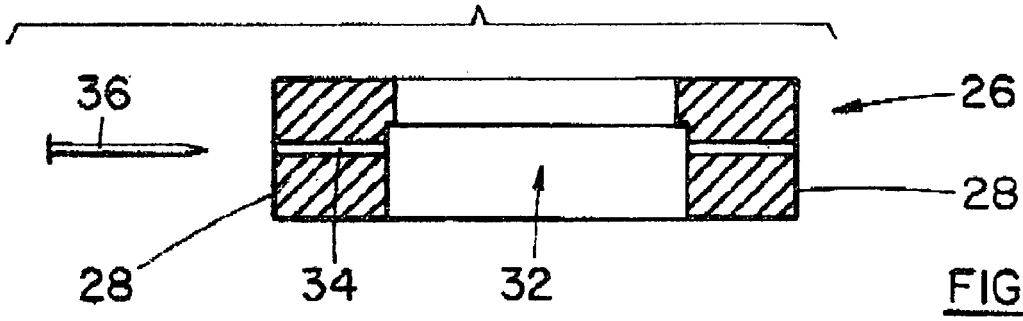
FIG. 5 is a section along 5—5 of FIG. 4.
Figure 6:
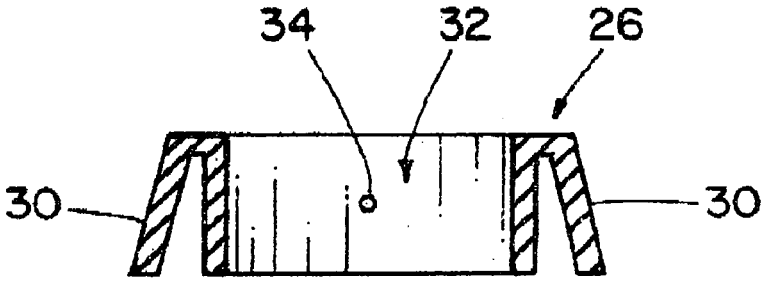
FIG. 6 is a section along 6—6.

In order to secure the vertical balusters (14—14) in position relative to the transverse rails (10A) (10B) interconnectors are provided, which in this case are in the form of locking block members (26) (FIGS. 4, 5 and 6). The locking block members (26) are preferably formed of thermoplastic material, having a suitable extended life. However other materials, may also be used for the purpose.

This is merely one preferred form of locking member. Other possible locking members are shown below, at FIGS. 7,8,9,15,16,and 21.

The locking block member (26) will have leading and trailing end surfaces (28—28), and angled side hooks (30—30). A central baluster opening (32) is formed through the locking block member (26) to receive the vertical baluster (14) therethrough. In order to provide for a secure permanent attachment, the locking block members (26) are formed with a nail receiving bore (34). A fastening such as a nail (36) (FIG. 5) may be inserted through the bore (34) and driven into the tubular material of the vertical baluster (14).

In order to assemble the basic fence structure, each of the vertical balusters (14) is cut to the appropriate length usually this will have been done in the factory. However it may be possible that it can be done by the home handyman or home owner. The lower locking block members (26), for example, may then be slid upwardly onto vertical balusters (14) and secured in position by nails (36). The vertical balusters (14) will then be slid upwardly through the holes (24) in the lower transverse rail (10B). By forcing the locking blocks (26) upwardly into the rail (10B), the wings or hooks (30) will flex inwardly due to the pressure of the sidewalls (18) of the rail (10B) and will then be snap fitted in position by means of the hook portions (22). A second set of locking block members (26) are then slid down onto the upper ends of their respective vertical balusters (14) and secured in position again by nails (36).

The upper ends of the vertical balusters (14) are then slid through the holes (24) in the upper transverse rail (10A), and the upper locking blocks (26) are then forced upwardly between the two side walls (18), and will be snap fitted into position by the hooks (22). In this way a secure engagement is provided between the vertical balusters (14) and the transverse rails (10A, 10B), by means of fastenings which are entirely concealed within the transverse rails, and which cannot be removed without virtually tearing the fence apart. In the case of the FIG. 3 embodiment there are no holes in the upper rail (10A). In this case the balusters will simply end within the rail but are retained in the same way as described.

Suitable corner support posts or columns (12) are placed at the-desired locations around the deck or yard or area to be enclosed. The ends of the transverse rails (10A) and (10B) are then secured to the vertical support posts (12) by means to be described below.

Figure 10:
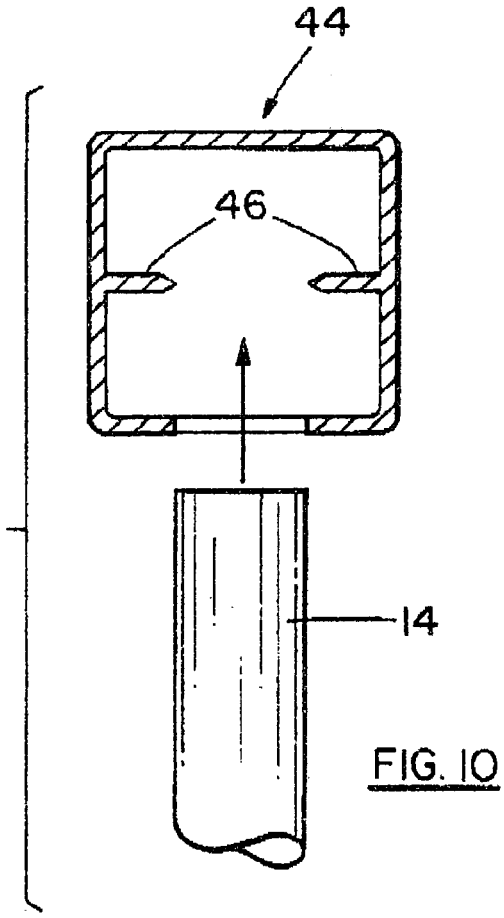
FIG. 10 is an exploded sectional view of an alternate form of railing system.
Figure 11:
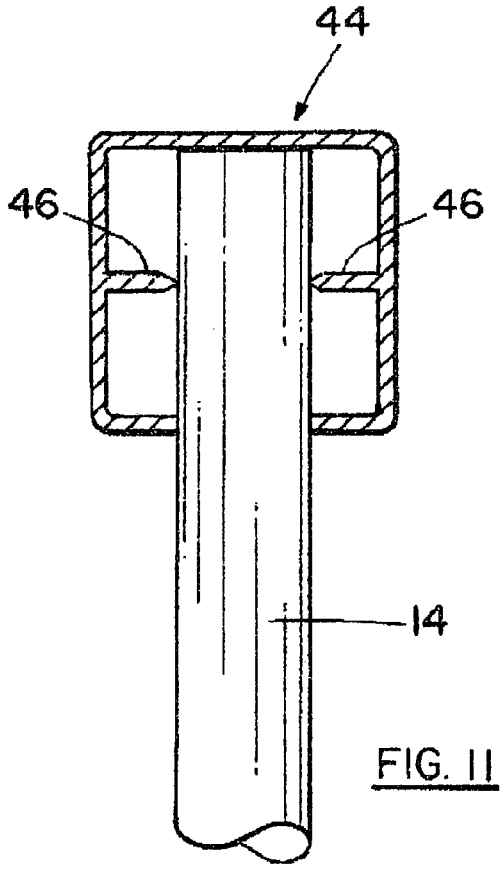
FIG. 11 is a view corresponding to FIG. 10 showing the parts interconnected.
Figure 7:
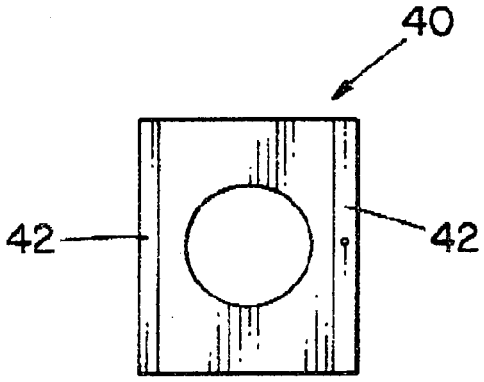
FIG. 7 is a plan view of a second form of connector.
Figure 8:
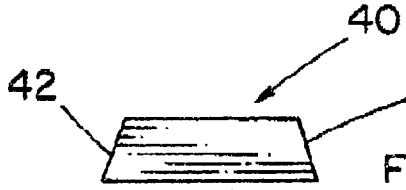
FIG. 8 is an elevation of FIG. 7.
Figure 9:
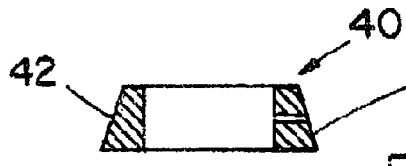
FIG. 9 is a section on line 9—9.

Alternate connectors are shown in FIGS. 7, 8 and 9. In this case the connecters (40) are formed as solid blocks, usually of thermoplastic material. The opposite sides (42) of the connector blocks (40) are formed at angles defining a generally tapering section. Connectors (40) are attached as in the same way as described above. However they are simply forced up into the transverse rails (10A, 10B). The angle and dimensions of the taper on the connectors (40) will be such that they will cause the side walls (18) of the transverse rails (10A, 10B) to flex slightly, and then snap back into position. The transverse rails may also be made as hollow four sided rectangular tubes (44) as shown in FIGS. 10 and 11.

In this case fastening of the balusters (14) is achieved by forming arms (46) along opposite side walls of the tube (44). The arms defining a spacing, and sharp edges. When a baluster (14) is inserted, the arms (46) will bite into the opposite sides of the baluster (14) and secure it.

Figure 12:
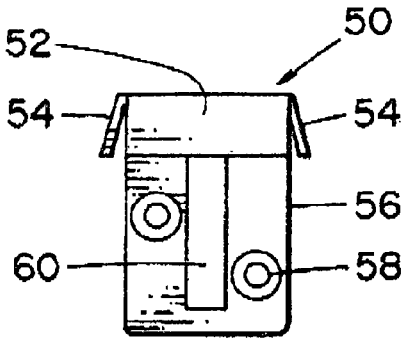
FIG. 12 is an end elevation of a form of transverse rail connector for connecting an end of a transverse rail to an upright post.
Figure 13:
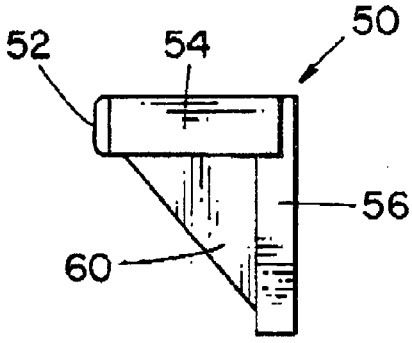
FIG. 13 is a side elevation of FIG. 12.
Figure 14:
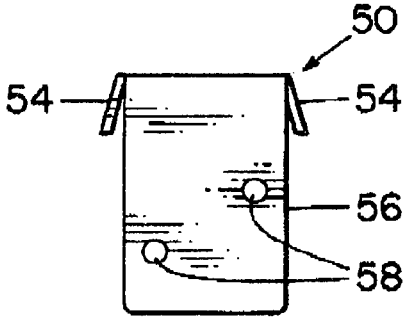
FIG. 14 is a rear elevation of FIG. 12.

Generally this system will be suitable only where the balusters (14) do not protrude through the upper (or under) wall of the tube. This is because the arms (46) will scratch the sides of the baluster (14) and if the baluster protrude right through the rail the sides of it would present an unsightly appearance. FIG. 10 shows a closed in top rail(44) but it will be appreciated that the lower rail would have openings similar to FIG. 2. The end connectors for coupling the ends of the rails to vertical posts are shown in more detail in FIGS. 12, 13 and 14. These will be seen to comprise in this particular embodiment, a generally L-shaped body (50) formed typically of thermoplastic, although it may be of metal. The L-shaped body (50) is formed with a transverse generally horizontal arm (52), having a generally tapering profile flexible arms as indicated at (54) in FIGS. 13 and 14. This enables it to be snap fitted into rail. The body (50) also has a generally vertical leg portion (56), provided for example with two screw holes (58), and typically having an angled reinforcement (60) extending between the leg and the arm.

Such bodies can be secured with screws not shown to the sides of the vertical support posts (12) of FIG. 1, and the transverse rails (10A, 10B)can be secured thereto thereby providing a complete railing.

Figure 16:
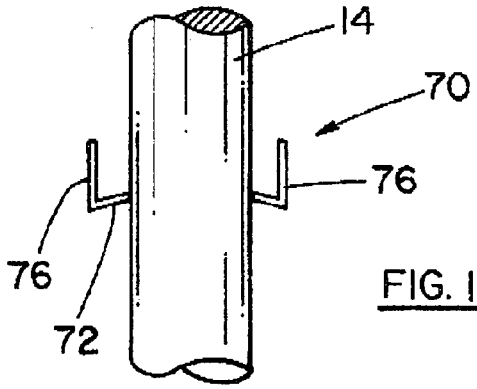
FIG. 16 is a section along the line 16—16 of FIG. 15, showing the connector on a baluster.
Figure 15:
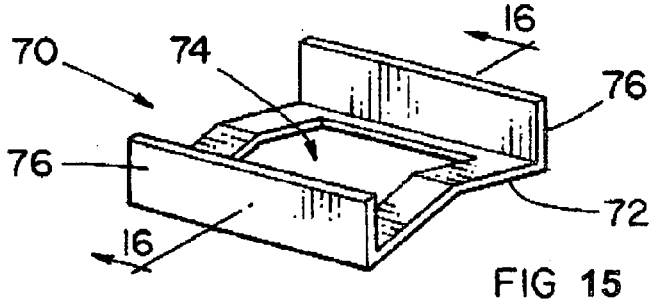
FIG. 15 is a perspective illustration of an alternate form of interconnector for interconnecting the balusters to the transverse rails.
Figure 17:
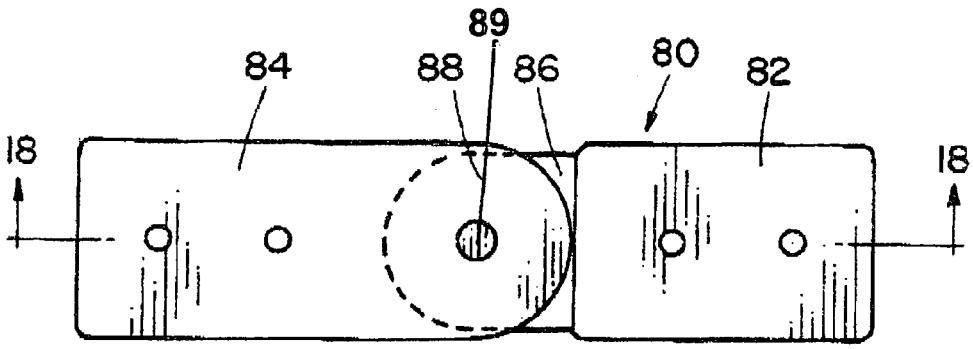
FIG. 17 is a top plan view of a hinged connector for connecting the two adjacent lengths of transverse rail together at an angle.

Alternate forms of interconnectors may be formed of sheet metal as shown in FIGS. 16 and 17.

Connecters (70) in this case are formed typically of sheet steel. There are formed with and angled central web (72) having a typically rectangular hole (74) therethrough. Side flanges (76) connect with the web (72). These connectors can be slid along the balusters (14) and wedged into the interior of the transverse rails (10A, 10B). Alternatively the connectors (70) can be slid along the interior of the rails (10A, 10B) and the baluster (14) slid upwardly into them.

Once engaged the angling of the web will prevent disassembly.

Figure 18:
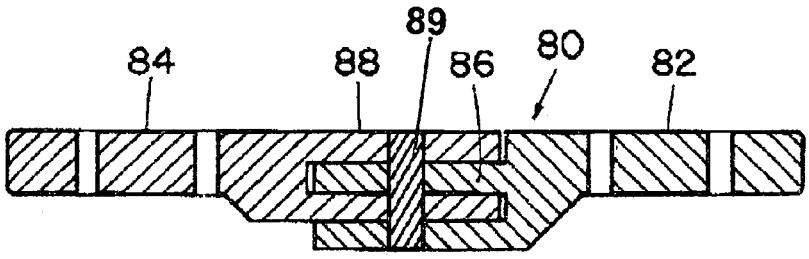
FIG. 18 is a section along the line 18—18 of FIG. 17.
Figure 19:
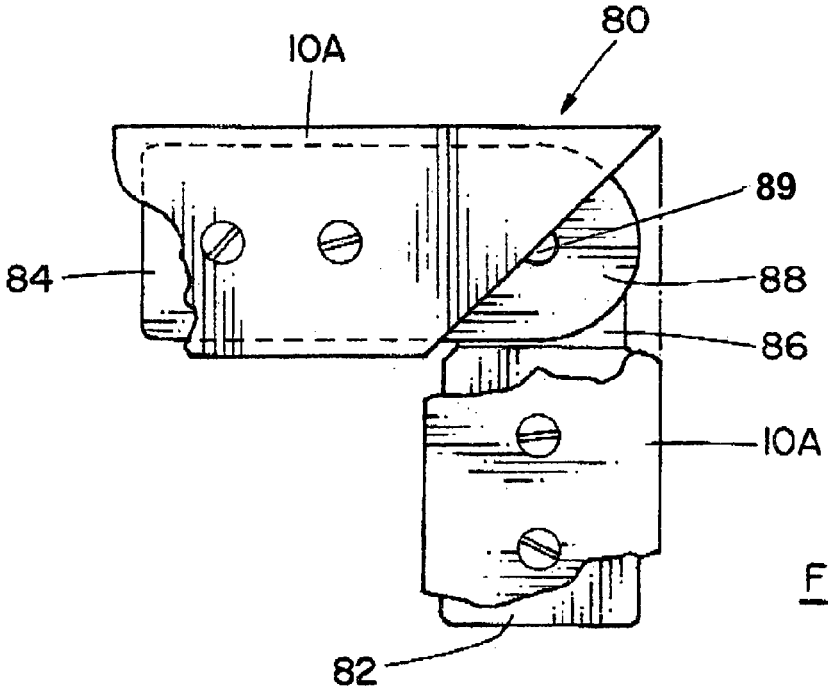
FIG. 19 is a top plan view of the connector, and showing two transverse rail portions partially cut away, joined at a right angle.

If it is desired to provide a railing having a series of lengths at angles to one another, which may be right angles or may be angles other than right angles, a generally hinged connector (80) may be provided as shown in FIGS. 17, 18 and 19. The hinged connectors are indicated generally as (80). It will consist of a first hinge portion (82) and a second hinge portion (84). Each of the hinge portion (82) and (84) will define an elongated generally rectangular shape adapted to fit into the adjacent ends of the rail (10A, 10B). The first hinge portion (82) in this embodiment is formed with two generally semi-circular tongue portions (86), and the second hinge portion (84) is provided with two similar generally semi-circular tongue portion (88). The tongue portions (86–88) are separate and interdigitate with one another as shown in FIG. 18. The hinge pin (89) will pass through a registering opening in tongue portions (86–88), and provide a pivot axis around which the two hinge portions can be swung relative to one another. Each of the hinge portions (82), (84) will be provided with screw holes for fastening to the adjacent ends of the rails (10A, 10B). As shown in FIG. 19, the two hinged portions can be swung for example as shown in FIG. 19 to an angle of 90 degrees, although any other angle between 180 degrees and 90 degrees is possible. The two railing portions (10A) and (10B) may be slid unto the hinge portions (82) and (84) and secured by screws as shown. The adjacent ends of the two railing portions ((10A, 10B)) will be cut at the appropriate angle so that they make a good mitred joint as shown in FIG. 19.

Figure 20:
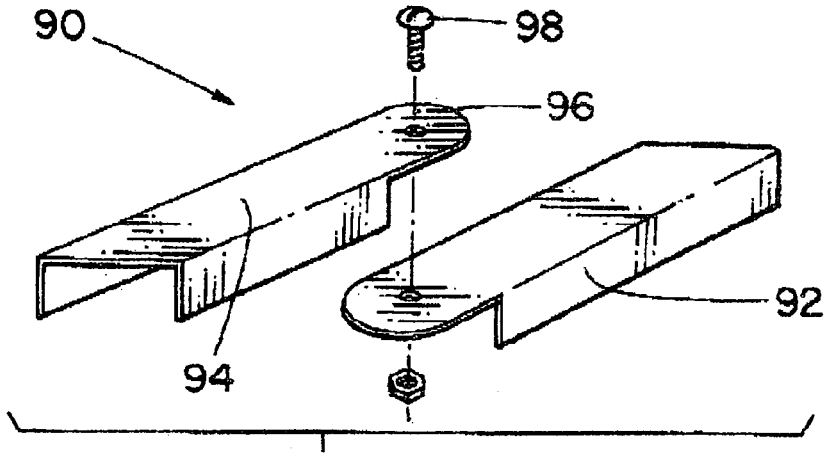
FIG. 20 is an exploded perspective illustration showing an alternate form of angle connector for connecting to portions of transverse rails at an angle.

An alternate form of swingable interconnector (90) may be formed of sheet metal as is shown in FIG. 20. In this case, the first hinge portion (92) and the second hinge portion (94) are both formed out of channel shaped sheet metal or extrusion.

A single tongue portion (96—96) extends from each hinge portion (92) and (94). A hinge pin bolt (98) passes through the two tongue portions and provides for a hinging action. The two channel portions can be slid into opposite ends of the rail portions, and secured as described above.

Figure 21:
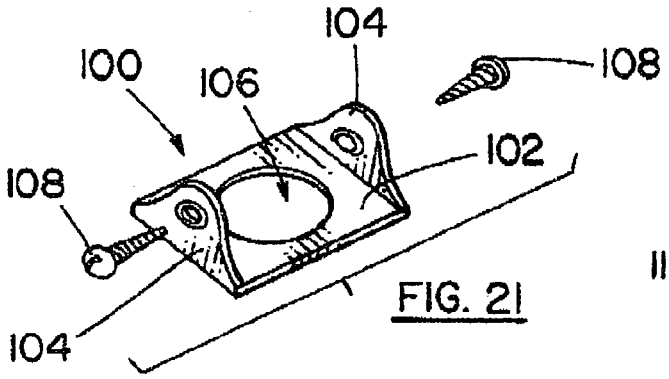
FIG. 21 is a perspective illustration of an alternate form of interconnector formed of sheet metal for interconnecting a baluster to a transverse rail.

An alternate embodiment for interconnecting the balusters with the rails is shown in FIG. 21. In this case, the interconnector (100) is formed of a metal having a web (102), and two right angle side portions (104). A circular opening (106) is formed through the web (102). Screws (108) pass through suitable screw holes in either side portion, and pass into the baluster (not shown) and in this way it is secured permanently in position. The shaping of the sides of the web, and the angling of the side portions in a generally triangular fashion, is such as to provide a secure fastening when inserted upwardly into an inverted channel shaped rails (10A–10B).

Figure 22:
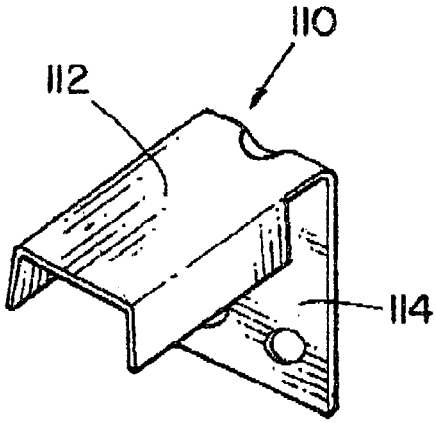
FIG. 22 is a perspective illustration of an alternate form of end connector for connecting the end of a transverse rail to a post.

An alternate form of end connector (110) is shown in FIG. 22 for connecting the end of a rail to a vertical post. This end connector (110) is a generally L-shaped structure having an arm portion (112) of generally channel shape in section, consisting of a web and two side portion walls. A vertical leg (114) extends downwardly from the arm (112) and is provided with screw holes for attaching it to the sides of the vertical post. This is used in essentially the same way as the end connection of FIGS. 16, 17 and 18 described above. In order to provide a decorative appearance to such a fence, various forms of decoration or finials may be attached such as the circular ornaments (120) of FIG. 1, or the post caps (122), other forms of decorations such as (124), can be substituted in place of the circular decorations.

These can be secured to the vertical balusters or to the upper ends of the posts and in this way a fence can be erected which has a variety of different decorative appearances and is appealing to many different tastes.

Figure 23:
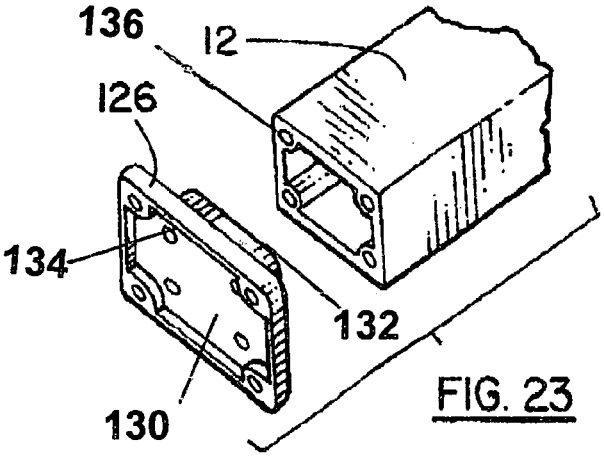
FIG. 23 is a perspective of a base for attaching a support post.

In order to complete the system, bases (126) FIG. 23 may be provided. Base (126) is of square shape in plan, and defines an upstanding wall (130) for receiving the post (12). A fastening flange (132) extends around the wall (130) and has holes for receiving screws to hold it in position. Interior fastening holes (134) are provided for screwing onto the lower end of a post. Typically the post will be formed with suitable screw receiving channels (136) of a type well known for receiving such screws.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A fence system which can be erected on site and comprising;

at least two transverse rails of metallic material, each of said transverse rails defining a hollow interior, and an inverted channel shaped section, defining an upper side and with resilient hook portions extending downwardly, having an open side oriented downwardly along an entire length of each rail, a plurality of spaced apart through baluster openings in at least one of said transverse rails, said through baluster openings being formed through said upper side of said at least one transverse rail;

a plurality of vertical baluster members, extending through said plurality of spaced apart baluster openings in said at least one of said transverse rails and interengaged with the transverse rails, with said vertical baluster members extending through said open side of said transverse rail through said through baluster openings therein, and, a plurality of interconnecting devices, each attachable to a vertical baluster member and which snap fit with the resilient hook portions of the transverse rails, so that the vertical baluster members can be connected with the transverse rails at spaced intervals, with the interconnecting devices entirely contained within said hollow interiors of said transverse rails, said interconnecting devices for fastening the vertical baluster members to the transverse rails defining through openings registering with said through baluster openigs in said transverse rail and through which said vertical baluster members extend, said interconnecting devices being entirely contained within said open sided channels of said transverse rails, so that said vertical baluster members protrude through said at least one transverse rail, and, fastenings for fastening said vertical baluster members within said interconnecting.

2. A fence system as claimed in claim 1 wherein the transverse rails and vertical baluster members are formed of metallic material, especially aluminium, which may have an exterior finish permanently applied in the factory, and highly resistant to weathering.

3. A fence system as claimed in claim 1 wherein the interconnecting devices are formed of spring metal for connecting the vertical baluster members and transverse rails.

4. A fence system as claimed in claim 1 including decorative attachments such as finials which can be interposed between the vertical baluster members, and on protruding ends thereof.

5. A fence system as claimed in claim 1 including angular connections connectable to the transverse rails whereby the rails may set at angles.

6. A fence system as claimed in claim 5 wherein the angular connections can provide both right angle joints and non-right angular joints in between lengths of transverse rails so as to provide a fence conforming to a desired shape.

7. A fence system as claimed in claim 1 wherein said interconnecting devices are formed of thermoplastic material, and define a body portion, a baluster opening through said body portion to receive a said baluster there through, and resilient hook portions extending from said body portion, whereby to engage the interior of said transverse rails.

8. A fence system as claimed in claim 7 wherein said interconnecting devises are formed with fastening bores intersecting said through opening, for receiving said fastenings there through whereby to secure said balusters in said through openings.

9. A fence system as claimed in claim 1 wherein the transverse rails are formed with interior arms extending there across and defining a spacing there between, for reception of a said baluster there between.

10. A fence system as claimed in claim 9 wherein the interior arms define end portions with edges formed thereon for engaging a baluster there between.

11. A fence system as claimed in claim 1 wherein the transverse rails are formed as hollow rectangular cross section tubes.

12. A fence system as claimed in claim 11 wherein the transverse rails are formed with interior arms extending there across from opposite sides of said rectangular tube section.

13. A fence system as claimed in claim 12 wherein the transverse rails define upper and under sides, and wherein they are formed with baluster openings, in at least one of said upper and under sides.

14. A fence system erected on site and comprising;

at least two transverse rails of metallic material, said transverse rails defining a hollow interior and an inverted channel shaped section, defining an upper side and with resilient hook portions extending downwardly, having an open side oriented downwardly along an entire length of each rail;

a plurality of spaced apart through openings in at least one of said transverse rails;

a plurality of vertical baluster members, interengaged with the transverse rails; said vertical baluster members extending completely through at least one of said transverse rails;

a plurality of interconnecting devices, each attachable to a vertical baluster member and which snap fit with the resilient hook portions of the transverse rails at spaced intervals, with the interconnecting devices entirely contained within said hollow interiors of said transverse rails;

said interconnecting devices for fastening the vertical baluster members to the transverse rails defining through openings registering with said through baluster openings in said transverse rail and through which said vertical baluster members extend, said interconnecting devices being entirely contained within said open sided channels of said transverse rails, so that said vertical baluster members protrude through said at least one transverse rail, fastenings for fastening said vertical baluster members within said interconnecting devices and a plurality of support posts secured at intervals whereby to support said transverse rails.

15. A fence system as claimed in claim 14 and including end connectors located at ends of said transverse rails and secured to said support posts.

16. A fence system as claimed in claim 15 and wherein said end connectors define leg portions fastened to said support posts, and arm portions extending from said leg portions and located within said hollow interior of said transverse rails.

17. A fence system as claimed in claim 14 wherein said interconnectiong devices are formed of thermoplastic material, and define a body portion, a baluster opening through said body portion to receive a said baluster there through, and resilient hook portions extending from said body portion, engaging the interior of said transverse rails.

* * * * *